US009623302B1

(12) United States Patent
Myers et al.

(10) Patent No.: US 9,623,302 B1
(45) Date of Patent: Apr. 18, 2017

(54) GOLF CLUB HEAD WITH ADJUSTABLE CENTER OF GRAVITY

(71) Applicant: CALLAWAY GOLF COMPANY, Carlsbad, CA (US)

(72) Inventors: Matthew Myers, Carlsbad, CA (US); James A. Seluga, Carlsbad, CA (US); Patrick Dawson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 14/755,068

(22) Filed: Jun. 30, 2015

Related U.S. Application Data

(63) Continuation-in-part of application No. 14/498,843, filed on Sep. 26, 2014, now Pat. No. 9,259,627, and a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned, application No. 14/755,068, filed on Jun. 30, 2015, which is a continuation-in-part of application No. 14/163,946, filed on Jan. 24, 2014, now Pat. No. 9,211,453, which is a continuation-in-part of application No. 13/766,658, filed on Feb. 13, 2013, now Pat. No. 8,790,195.

(60) Provisional application No. 62/052,343, filed on Sep. 18, 2014, provisional application No. 61/657,247, filed on Jun. 8, 2012, provisional application No. 61/684,079, filed on Aug. 16, 2012, provisional application No. 61/665,203, filed on Jun. 27, 2012, provisional application No. 61/746,348, filed on Dec. 27, 2012.

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/0433* (2013.01); *A63B 2053/0491* (2013.01)

(58) Field of Classification Search
CPC ..... A63B 53/04; A63B 53/0466; A63B 53/06; A63B 2053/0491; A63B 2053/0433
See application file for complete search history.

(56) References Cited

U.S. PATENT DOCUMENTS 5,683,309 A * 11/1997 Reimers ..... A63B 53/04 473/337
6,277,032 B1 * 8/2001 Smith ..... A63B 53/04 473/336

(Continued)

*Primary Examiner* — Stephen Blau
(74) *Attorney, Agent, or Firm* — Rebecca Hanovice; Michael Catania; Sonia Lari

(57) ABSTRACT

A golf club head with means for adjusting a center of gravity location along more than one axis is disclosed herein. The golf club head comprises one or more adjustable features, including a weight arm for receiving removable weights, e.g., slidable weights, weight screws, and invertible weight cartridges, and one or more invertible weight cartridges that fit within a tube extending between the golf club head's crown and sole via an interior cavity. The weight arm fits within a rectangular, elongated cutout in the sole and permits the golfer to adjust the location of one or more removable weights along its length.

17 Claims, 8 Drawing Sheets

(56) References Cited

U.S. PATENT DOCUMENTS

| | | | | |
|---|---|---|---|---|
| 7,611,424 | B2 * | 11/2009 | Nagai | A63B 53/0466 473/334 |
| 7,997,998 | B2 * | 8/2011 | Bennett | A63B 53/0466 473/328 |
| 8,202,175 | B2 * | 6/2012 | Ban | A63B 53/0466 473/334 |
| 8,425,348 | B2 * | 4/2013 | Boyd | A63B 53/0466 473/335 |
| 8,684,863 | B2 * | 4/2014 | Bezilla | A63B 53/06 473/334 |
| 8,870,679 | B2 * | 10/2014 | Oldknow | A63B 53/06 473/335 |
| 8,894,506 | B1 * | 11/2014 | Myers | A63B 53/0466 473/334 |
| 2010/0292027 | A1 * | 11/2010 | Beach | A63B 53/0466 473/334 |
| 2014/0038746 | A1 * | 2/2014 | Beach | A63B 53/0466 473/335 |
| 2014/0080628 | A1 * | 3/2014 | Sargent | A63B 53/0466 473/336 |

* cited by examiner

GOLF CLUB HEAD WITH ADJUSTABLE CENTER OF GRAVITY

The present application is a continuation-in-part of U.S. patent application Ser. No. 14/498,843, filed on Sep. 26, 2014, which claims priority to U.S. Provisional Patent Application No. 62/052,343, filed on Sep. 18, 2014, and is a continuation-in-part of U.S. patent application Ser. No. 14/173,615, filed on Feb. 5, 2014, which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, which claims priority to U.S. Provisional Patent Application No. 61/657,247, filed on Jun. 8, 2012, 61/684,079, filed on Aug. 16, 2012, and 61/665,203, filed on Jun. 27, 2012, the disclosure of each of which is hereby incorporated by reference in its entirety herein. The present application is also a continuation-in-part of U.S. patent application Ser. No. 14/163,946, filed on Jan. 24, 2014, which is a continuation-in-part of U.S. patent application Ser. No. 13/766,658, filed on Feb. 13, 2013, and issued on Jul. 29, 2014, as U.S. Pat. No. 8,790,195, which claims priority to U.S. Provisional Patent Application No. 61/746,348, filed on Dec. 27, 2012, the disclosure of each of which is hereby incorporated by reference in its entirety herein.

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head having a plurality of adjustable features that allow the club head's center of gravity to be moved along multiple axes.

Description of the Related Art

The ability to adjust center of gravity location and weight in the head of golf clubs is useful for controlling performance of the golf club, particularly in wood-type golf clubs such as drivers. The prior art includes several different solutions for adjustable weighting, but these solutions do not optimize weight adjustment because they typically allow for center of gravity (CG) adjustment along only one axis. See, for example, U.S. Pat. Nos. 7,611,424 and 8,016,694. Therefore, there is a need for a weighting mechanism that allows for simple and flexible center of gravity and moment of inertia (MOI) adjustability along more than one axis.

BRIEF SUMMARY OF THE INVENTION

The present invention is a novel way of working with adjustable products. The present invention allows consumers to adjust the center of gravity of a golf club head along both vertical and horizontal axes. The objective of this invention is to provide a plurality of adjustable weights with minimal or no effect on appearance at address while maximizing the ability of the weight to adjust center of gravity height.

One aspect of the present invention is a golf club head comprising a body having a face, a sole, a crown, and a hosel, means for adjusting a center of gravity along a horizontal axis perpendicular to the face, and means for adjusting the center of gravity along a vertical axis.

Another aspect of the present invention is a golf club head comprising a body comprising a face, a rear portion, a hinge, an interior cavity, and a hosel, an elongated weight arm comprising a first end, a second end, and a hinge receiver disposed at the second end, and a retaining cap, wherein the body comprises an elongated cutout sized to receive at least a portion of the elongated weight arm, wherein the hinge is located at the rear portion of the body proximate a first end of the elongated cutout, wherein the hinge receiver removably latches onto the hinge, wherein the retaining cap reversibly locks the elongated weight arm within the elongated cutout, and wherein a lower surface of the elongated weight arm is flush with an external surface of the body when the elongated weight arm is disposed within the elongated cutout.

In some embodiments, the golf club head may further comprise a weight cartridge, and the elongated weight arm may comprise an elongated recessed region sized to receive the weight cartridge. In a further embodiment, the elongated weight arm may further comprise a clip feature sized to retain the weight cartridge within the elongated recessed region. The elongated weight arm may also comprise an overhang region disposed at a first end of the elongated weight arm. In a further embodiment, the clip feature may be disposed at a second end of the elongated weight arm, and the overhang region and the clip feature cooperate to removably retain the weight cartridge within the elongated recessed region.

In other embodiments, the golf club head may further comprise a cap screw having a lip portion and external threads, the body may comprise an opening proximate a second end of the elongated cutout, and the opening may comprise internal threads sized to engage with the external threads. In a further embodiment, the first end of the elongated weight arm may comprise a through bore, and at least a portion of the cap screw may extend through the through bore and engage the internal threads in the opening. In yet a further embodiment, the lip portion may extend over a portion of the weight arm surrounding the through bore when the cap screw is fully engaged with the opening, thus pressing the elongated weight arm against the body and preventing the elongated weight arm from moving while the golf club head is in use.

In some, further embodiments, the golf club head may comprise a tube and a weight cartridge, the body may comprise a crown and a sole, the cutout and the opening may be disposed in the sole, the tube may extend between the crown and the sole through the interior cavity, the opening may communicate with the tube, and the weight cartridge may be sized to fit within the tube. In some embodiments, the elongated weight arm may comprise an elongated recessed region sized to receive the weight cartridge. In other embodiments, the cap screw may comprise a counterbore, the weight cartridge may comprise a first end with a first density and a second end with a second density, and the counterbore may be sized to receive at least one of the first and second ends of the weight cartridge. In a further embodiment, the first density may be greater than the second density. In another embodiment, the cap screw may press the weight cartridge against an internal surface of the crown. In yet another embodiment, each of the face and the sole may be composed of a metal material and the elongated weight arm may be composed of a non-metal material. In another embodiment, each of the crown and the elongated weight arm may be composed of a composite material.

Yet another aspect of the present invention is a golf club head comprising a body comprising a face, a rear portion, an interior cavity, and a hosel, an elongated weight arm comprising a first end, a second end, a lower surface, and an elongated recess comprising a floor and at least two sides, and a slidable weight, wherein the body comprises an elongated cutout sized to receive at least a portion of the elongated weight arm, wherein at least two of the sides of the elongated recess comprises a rail, wherein the slidable weight comprises rail-gripping features, and wherein a lower surface of the elongated weight arm is flush with an external surface of the body when the elongated weight arm is disposed within the elongated cutout. In some embodiments, the slidable weight may comprise two pieces and a bolt. In another embodiment, the golf club head may further comprise a retaining cap, which may reversibly lock the elongated weight arm within the elongated cutout. In a further embodiment, the body may comprise a hinge disposed at a first end of the elongated cutout, the elongated weight arm may comprise a hinge receiver sized to removably latch onto the hinge, and the elongated weight arm may pivot around the hinge when the hinge receiver is engaged with the hinge.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
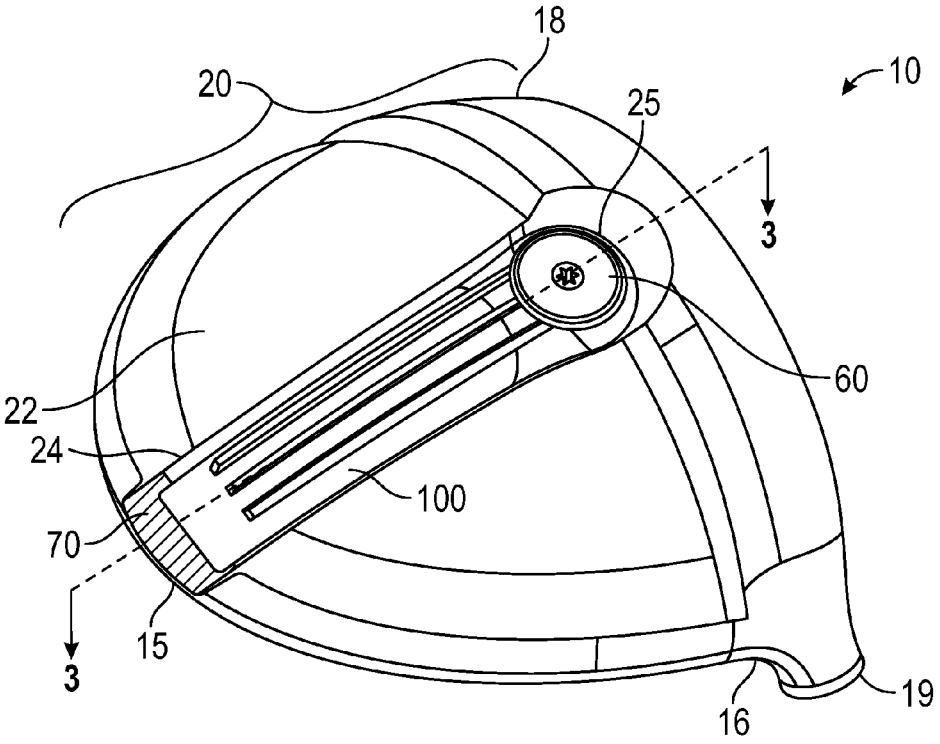
FIG. 1 is a sole perspective view of a golf club head encompassing a first embodiment of the present invention.
Figure 2:
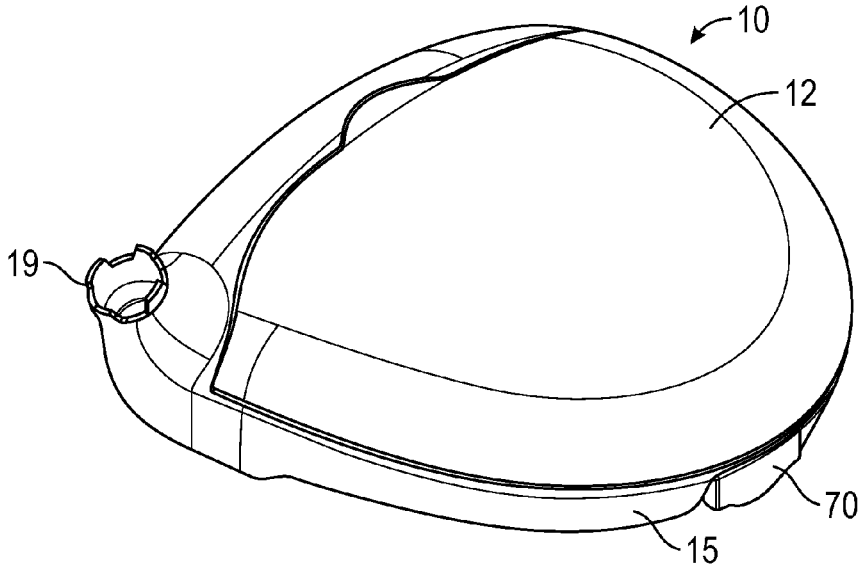
FIG. 2 is a crown perspective view of the embodiment shown in FIG. 1.
Figure 3:
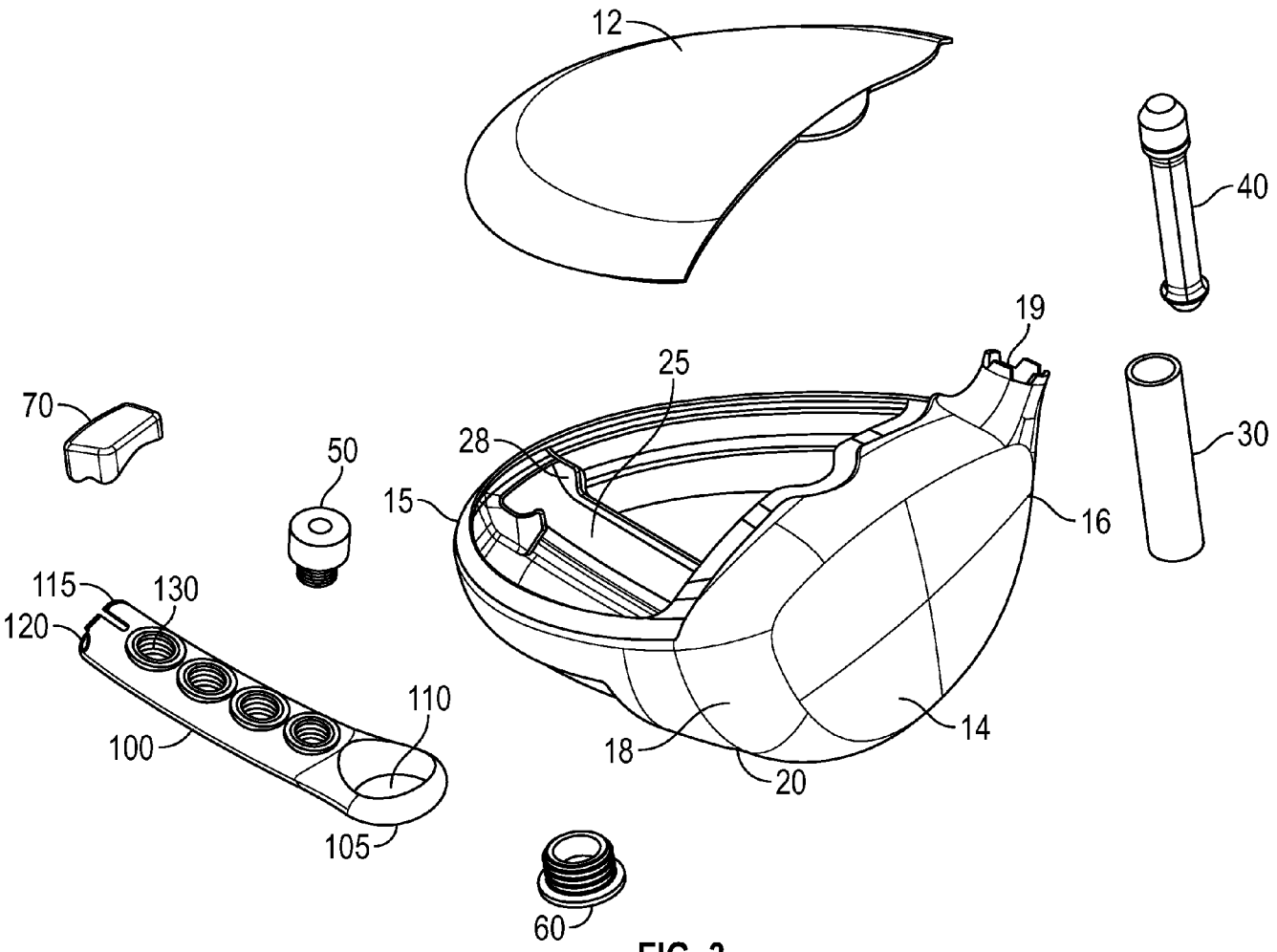
FIG. 3 is an exploded, perspective view of the embodiment shown in FIG. 1.
Figure 4:
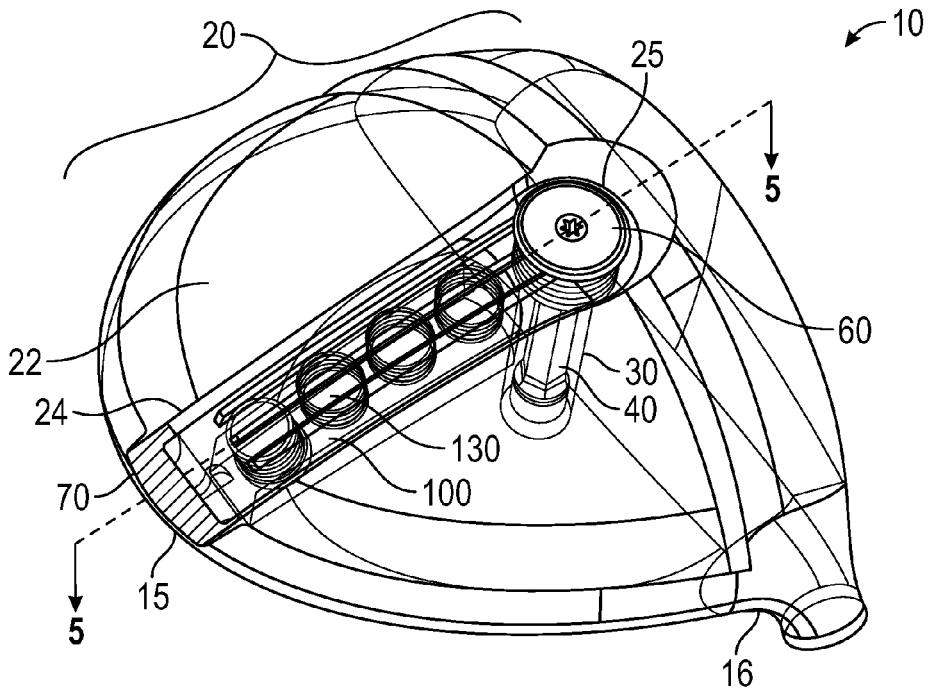
FIG. 4 is a sole perspective, partially transparent view of the embodiment shown in FIG. 1.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup, and particularly with a skeletal metal/composite structure such as the one disclosed in U.S. patent application Ser. No. 14/162,633, the disclosure of which is hereby incorporated by reference in its entirety herein. The weighting embodiments disclosed herein will also work in conjunction with at least one adjustable weight port on the crown of the driver head, and will also work in connection with non-driver clubs, such as fairway woods, hybrids, irons, and putters. Shifting weight as described herein allows for precise control over the golf club head's center of gravity location.

A first embodiment of the present invention is shown in FIGS. 1-7. The golf club head 10 comprises a crown 12, a sole 20, a face 14, a rear portion 15, a heel 16, a toe 18, and a hosel 19. The sole 20 comprises recessed region 22 located at least 0.10 inch away from the face, with an approximately rectangular, elongated cutout 24 extending across the sole perpendicular to the face 14 in a face 14 to rear portion 15 direction, though in alternative embodiments this elongated cutout 24 may extend in any direction across the sole 20. Including a cutout 24 instead of a secondary recessed sole region reduces the overall mass of the golf club head 10 and increases the discretionary mass available to a golfer to adjust the mass properties of the golf club head 10. The elongated cutout 24 abuts an opening 25 in a forward area 23 of the sole 20; this opening 25 communicates with a tube 30 that extends between the crown 12 and the sole 20 and is sized to receive an adjustable weight cartridge 40. The opening 25 and tube 30 preferably are disposed at the face-most portion of the sole 20, but in alternative embodiments may be disposed anywhere along the length of the sole 20, including its rear-most portion. In other embodiments, such as those disclosed in U.S. patent application Ser. No. 14/498,843, the elongated cutout 24 may be replaced with an elongated recessed region with multiple openings, and multiple tubes 30 may be disposed along the sole 20 to receive more than one adjustable weight cartridge 40.

As shown in these figures, a weight arm 100 is sized to fit within the elongated cutout 24 so that it its lower surface 102 is flush with at least the sole 20, or, more preferably, with the recessed region 22. The weight arm 100, shown in more detail in FIGS. 3, 5, and 7, comprises a first end 105 with a through bore 110, a second end 115 with a hinge receiver 120, and a plurality of openings 130 disposed along the length of the weight arm 100 with equal spacing between each opening 130. In an alternative embodiment, the openings 130 may be spaced from one another at different lengths. The hinge receiver 120 is sized to removably latch or clip onto a hinge 28 disposed at a rear portion 15 of the sole 20 proximate the cutout 24, and allows the weight arm 100 to pivot around the hinge 28 towards and away from the sole 20. The weight arm 100 is then removably fixed within the elongated cutout 24 with a retaining cap 70 that physically prevents the weight arm 100 from pivoting around the hinge 28 by blocking its movement, as shown in FIGS. 1, 2, 4, and 5. The weight arm 100 preferably is sized to cover the cutout 24 completely so that dirt and other detritus cannot enter the golf club head 10 when it is in use.

Figure 5:
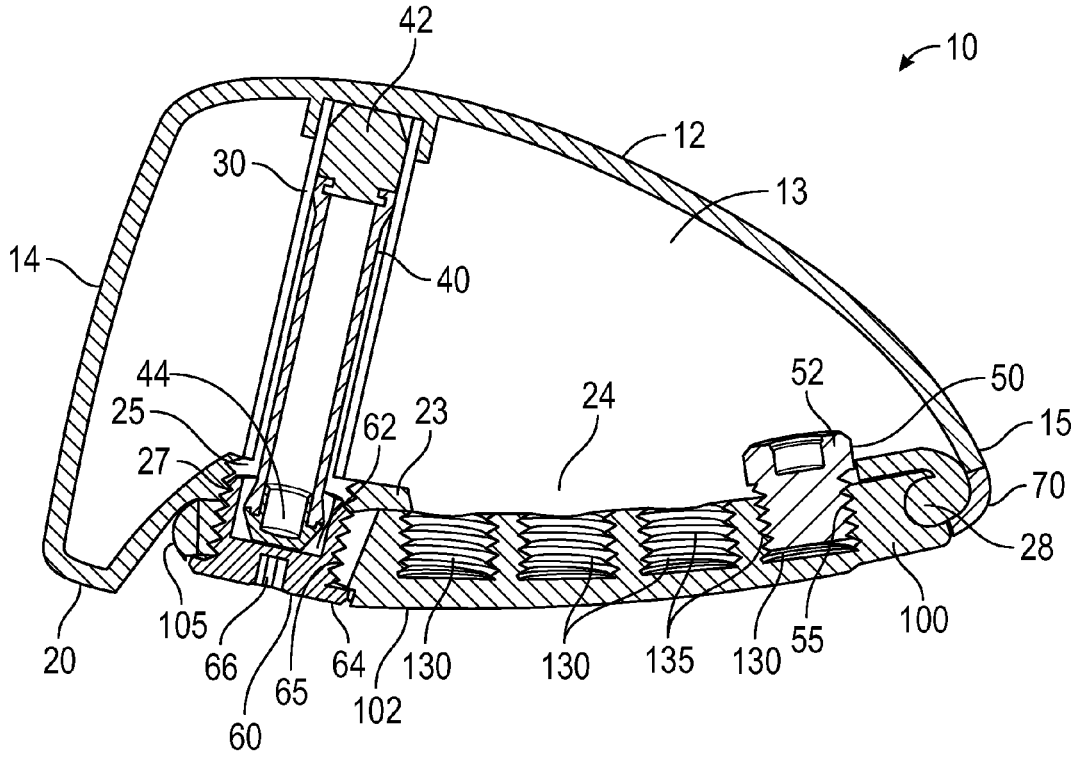
FIG. 5 is a cross sectional view of the embodiment shown in FIG. 4 along lines 5-5.
Figure 6:
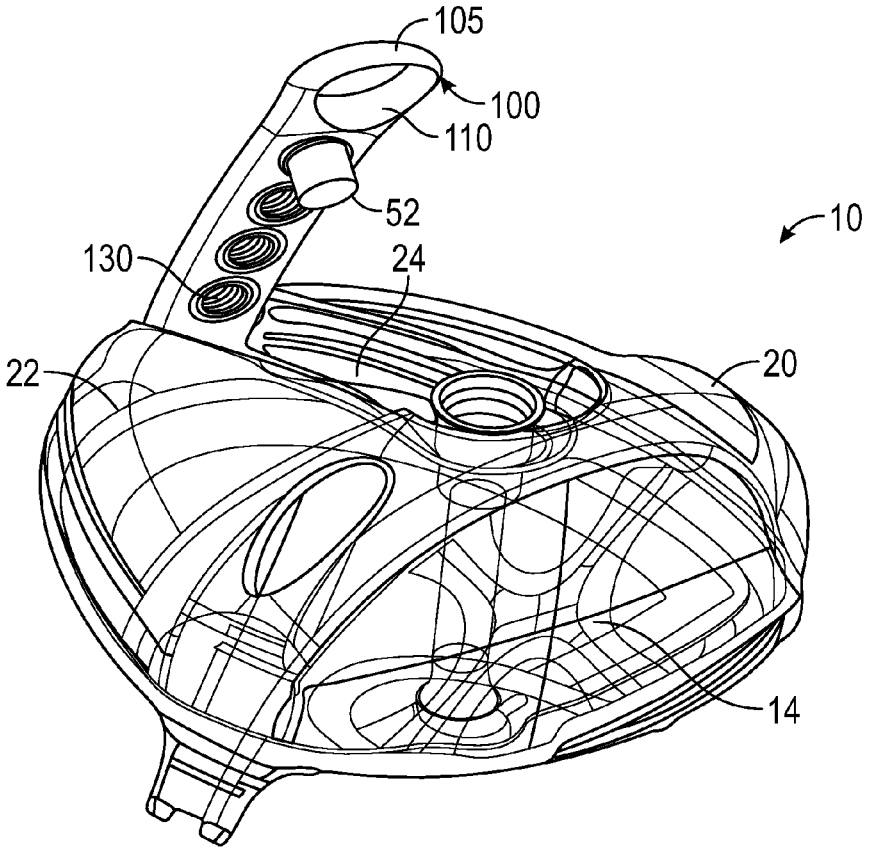
FIG. 6 is a side perspective, partially transparent view of the embodiment shown in FIG. 1 with the weight arm partially engaged with the sole, and without the retaining cap.
Figure 7:
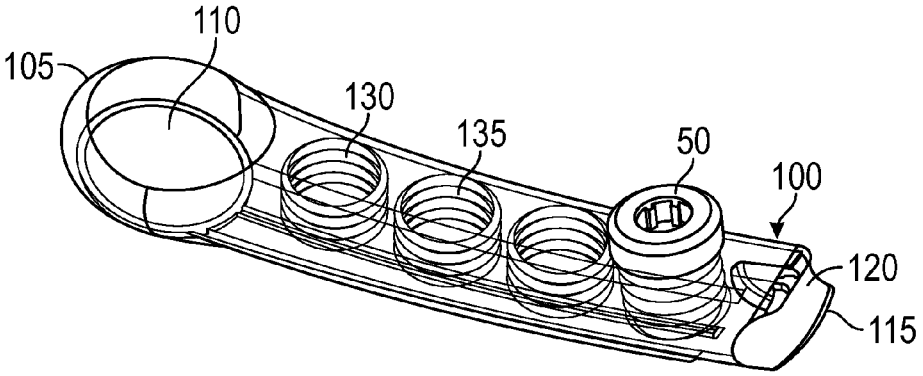
FIG. 7 is a side, partially transparent view of the weight arm engaged with a weight screw.
Figure 8:
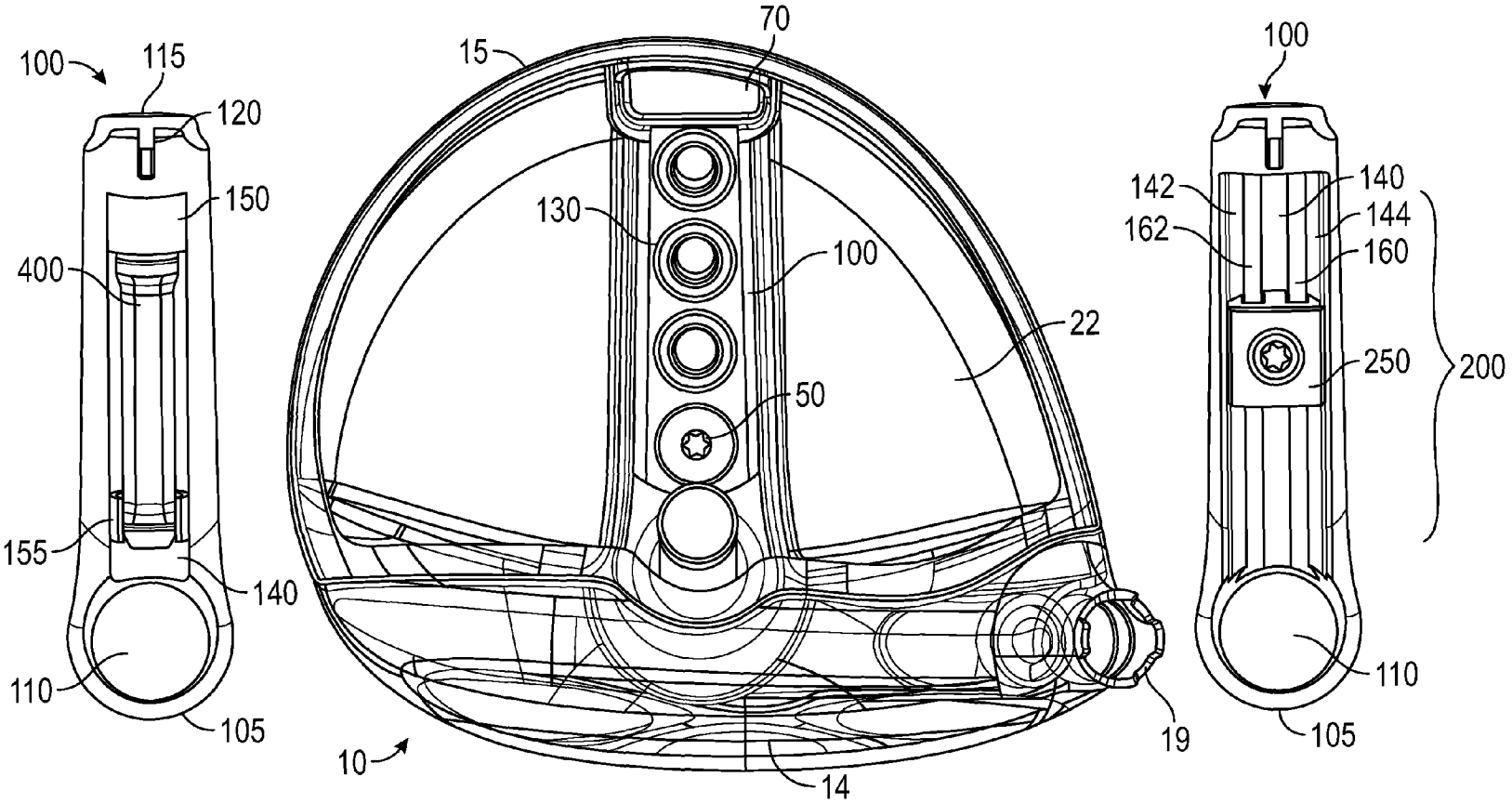
FIG. 8 is a top perspective, partially transparent, view of the embodiment shown in FIG. 1 without its crown, and two alternative weight arm embodiments.
Figure 9:
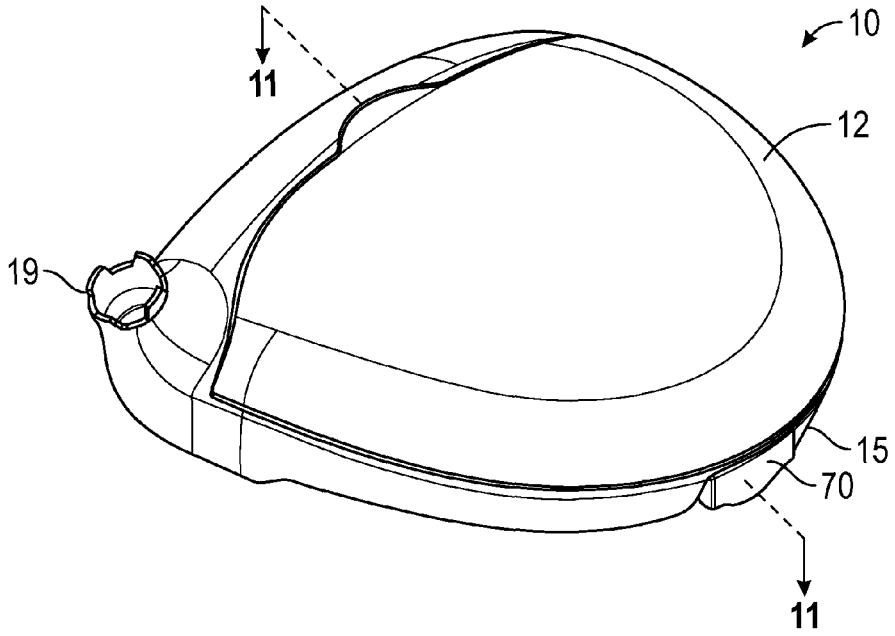
FIG. 9 is a crown perspective view of the golf club head shown in FIG. 1 engaged with the first alternative weight arm embodiment shown in FIG. 8.
Figure 10:
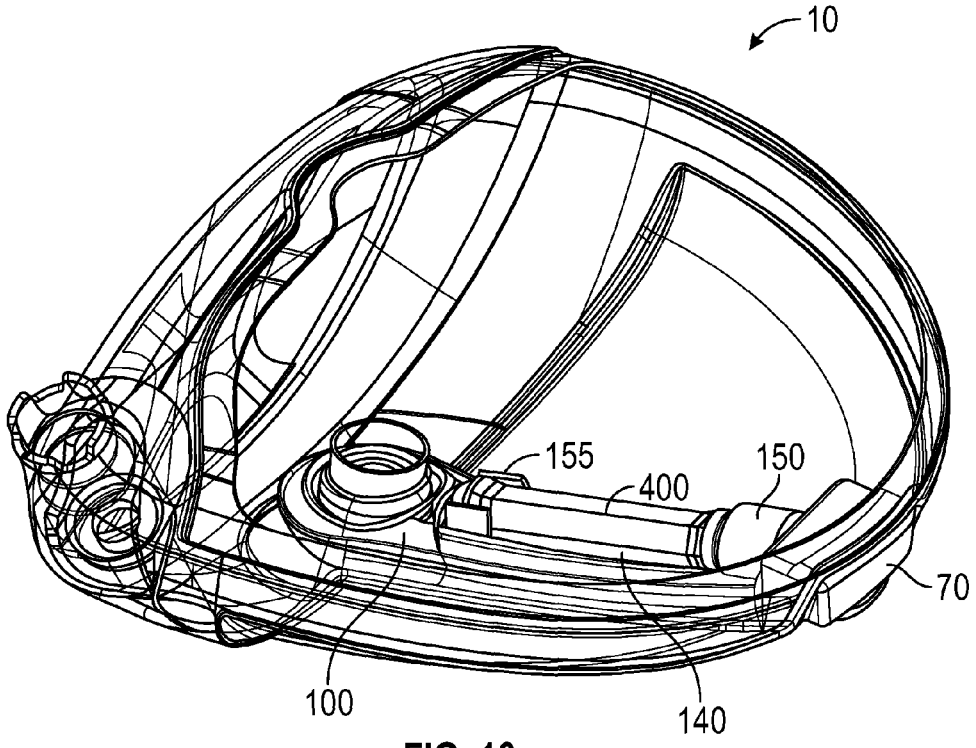
FIG. 10 is a crown perspective, partially transparent view of the embodiment shown in FIG. 9 without its crown.
Figure 11:
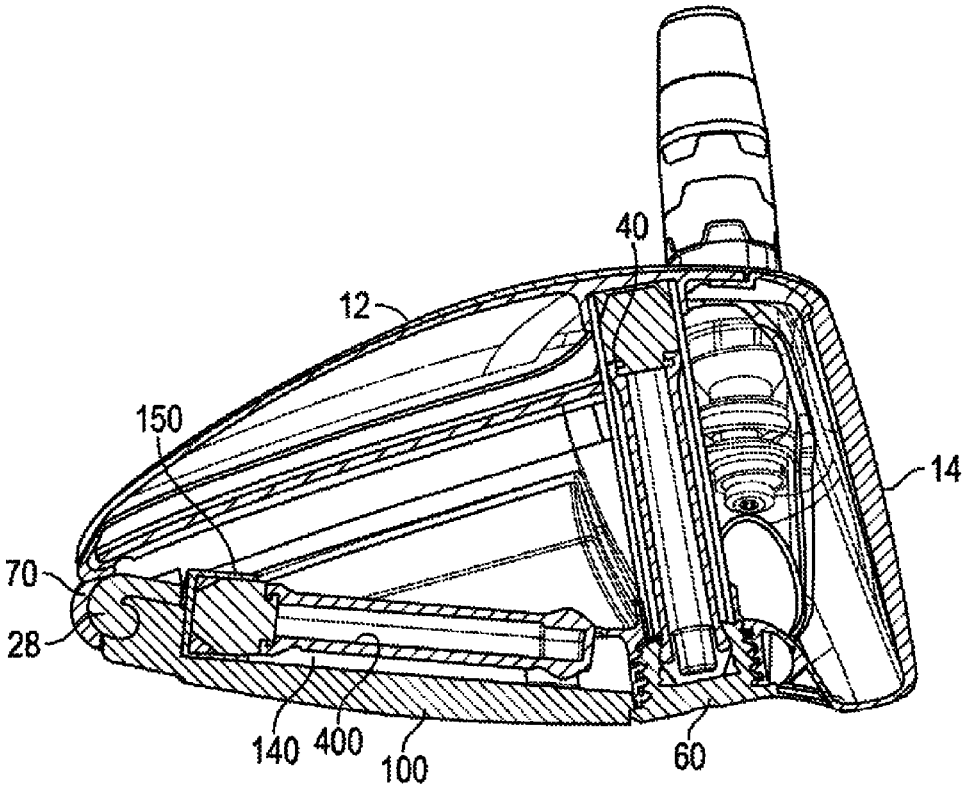
FIG. 11 is a cross-sectional view of the embodiment shown in FIG. 9 along lines 11-11.
Figure 12:
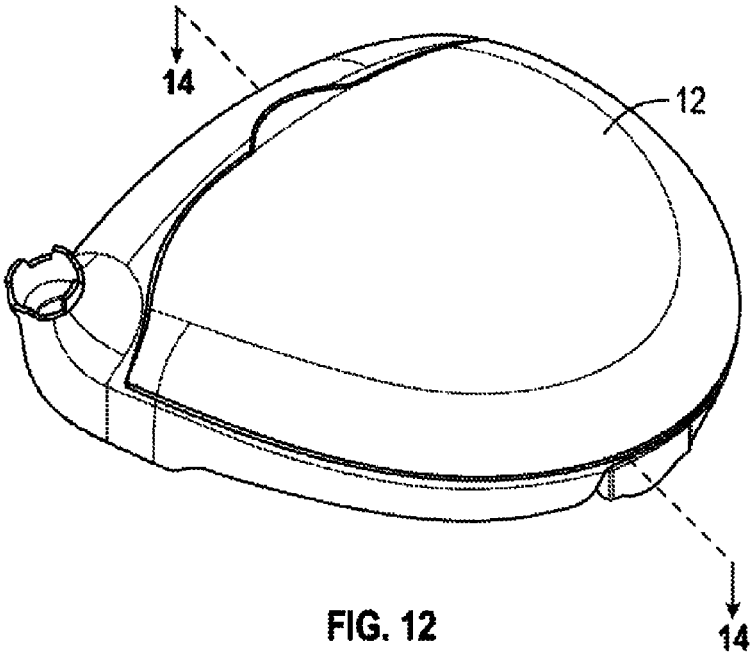
FIG. 12 is a crown perspective view of the golf club head shown in FIG. 1 engaged with the second alternative weight arm embodiment shown in FIG. 8.
Figure 13:
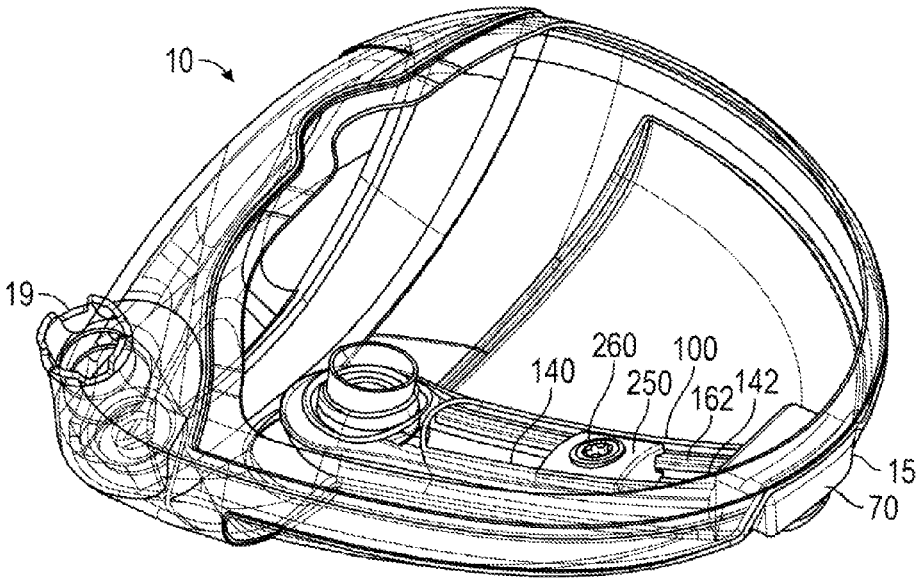
FIG. 13 is a crown perspective, partially transparent view of the embodiment shown in FIG. 12 without its crown.
Figure 14:
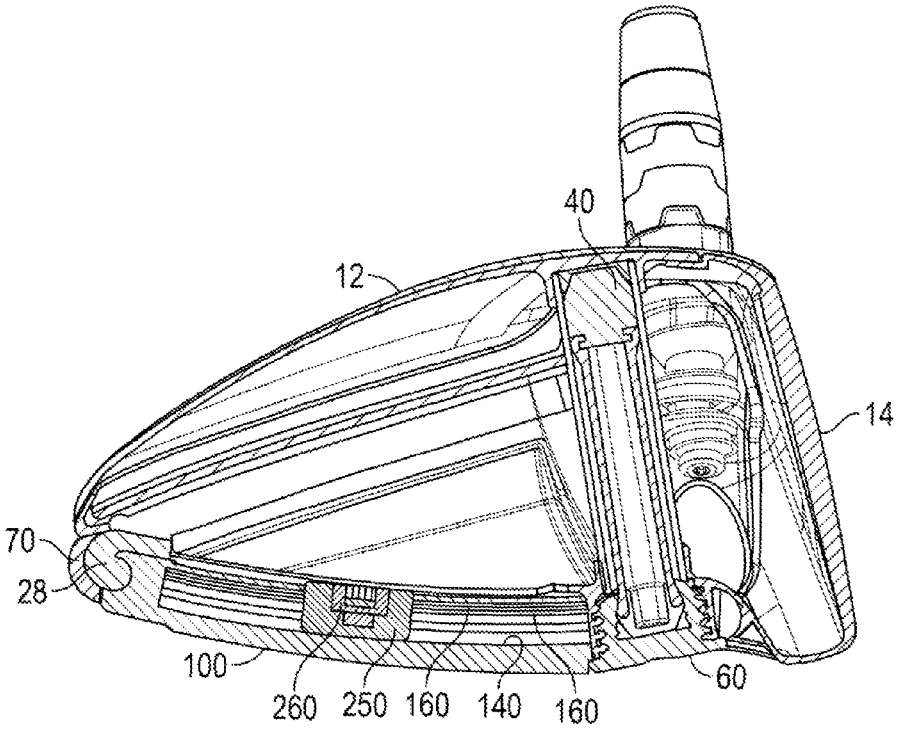
FIG. 14 is a cross-sectional view of the embodiment shown in FIG. 12 along lines 14-14.

In the embodiment shown in FIGS. 1-7, each opening 130 comprises internal threads 135 sized to receive the external threads 55 on a weight screw 50, which can be removed and moved to different openings 130 along the weight arm 100, thus adjusting the face-to-rear location of the golf club head 10 center of gravity. Multiple weight screws 50 can be used with the golf club head 10 so that two or more openings 130 hold a weight screw 50, or the openings 130 can be left empty, depending on the overall weight and mass properties desired by a golfer. As shown in FIG. 5, each weight screw 50 extends through the cutout 24 and protrudes into the interior cavity 13 of the golf club head 10 when the weight arm 100 is fully engaged with the golf club head 10. The heads 52 of the weight screws 50 can be longer or shorter in the length than the one shown in the Figures, depending on how significantly a golfer would like to affect the vertical center of gravity location of the golf club head 10. The weight screws 50 can be made of any material known to a person skilled in the art, and may be made of multiple materials.

The through bore 110 of the weight arm 100 is sized and shaped to line up with and fit within the opening 25 in the sole 20 when the weight arm 100 is properly disposed within the cutout 24. As shown in FIG. 5, the opening 25 in the sole comprises internal threading 27, which mates with external threads 65 on a cap screw 60 sized to fit through the through bore 110 of the weight arm 100 and close up the opening 25. The cap screw 60, which includes a tool receiving region 66 to engage with a screwdriver, Torx® wrench, or other such tool, may also include a lip portion 64 that extends over the area of the weight arm 100 that surrounds the through bore 110, such that the cap screw 60 retains the first end 105 of the weight arm 100 on the golf club head 10, while the retaining cap 70 retains the second end 115 of the weight arm 100 on the golf club head 10.

The cap screw 60 also comprises a counterbore 62 that is sized to receive each of the ends 42, 44 of the weight cartridge 40. When one of the ends 42, 44 of the weight cartridge 40 is disposed within the counterbore 62 and the cap screw 60 is fully engaged with the internal threading 27, the cap screw 60 presses the weight cartridge 40 against an internal surface of the crown 12 and retains it securely within the tube 30. If a golfer wishes to reverse the orientation of the weight cartridge 40, he or she need only unscrew the cap screw 60, remove the weight cartridge 40, flip it upside down so that a different end 42, 44 is disposed within the counterbore 62, reinsert the cartridge 40 into the tube and re-screw the cap screw 60 into the opening 25 in the sole 20.

As shown in the Figures, the weight cartridge 40 preferably is cylindrical, and preferably has a first end 42 formed from a denser material or combination of materials than a second end 44. In this embodiment, when a first end 42 of the weight cartridge 40 is inserted into the tube 30, such that the second end 44 is disposed proximate the sole 20, the vertical center of gravity of the golf club head 10 is higher than when the second end 44 of the weight cartridge 40 is inserted into the tube 30 such that the first end 42 is disposed proximate the sole 20. In other words, removing, inverting, and then reinserting the weight cartridge 40 into the tube 30 alters the vertical location of the golf club head 10 center of gravity.

The weight arm 100 of the present invention may, in alternative embodiments, hold different types of weighting elements instead of weight screws, and a golf club head 10 may be provided to a user with multiple weight arms 100 comprising different weighting elements so that the user can change the golf club head's 10 weight characteristics. This can be accomplished simply by unclipping the hinge receiver 120 from the hinge 28, removing the weight arm 100, and replacing it with another weight arm 100 having a different weight assembly. Two alternative weighting options are shown in FIGS. 8-14, one having a slidable weight assembly 200 and another having a secondary weight cartridge 400.

In the embodiment including a secondary weight cartridge 400, shown in more detail in FIGS. 8-11, the weight arm 100 has an elongated recessed region 140 sized to receive the secondary weight cartridge 400, which may have any or all of the characteristics of the other weight cartridge 40 disclosed herein. The weight arm 100 also includes an overhang region 150, which extends over a portion of the recessed region 140 and under which one end of the secondary weight cartridge 400 can be placed to secure it within the recessed region 140. The weight arm 100 further secures the secondary weight cartridge 400 within the recessed region 140 with a clip feature 155 spaced away from the overhang region 150, preferably at the opposite end of the recessed region 140. The overhang region 150 and clip feature 155 releasably lock the cartridge 400 in the recessed region 140 so that it does not move when the golf club head 10 is in use. In this embodiment, the recessed region 140 preferably is sized to receive either of the weight cartridges 40, 400 disclosed herein so that these cartridges 40, 400 can be exchanged by a golfer to further adjust the mass properties of the golf club head 10.

In the embodiment including a slidable weight assembly 200, shown in more detail in FIGS. 8 and 12-14, the weight arm 100 has an elongated recessed region 140 with a pair of rails 160, 162 protruding from the sides 142, 144 of the elongated recessed region 140. These rails 160, 162 are gripped by a two piece slidable weight 250, which includes a bolt 260 that, when tightened, pulls the two pieces of the slidable weight 250 together to grip the rails 160, 162. When the bolt 260 is loosened, the two pieces of the slidable weight 250 move apart from one another, loosening the grip on the rails 160, 162 and allowing the slidable weight 250 to move within the elongated recessed region 140 along the rails 160, 162. In alternative embodiments, the slidable weight assembly 200 located on the weight arm 100 may have any or all of the characteristics of the slidable weight assemblies disclosed in U.S. patent application Ser. Nos. 14/707,829, 14/173,615, 14/163,946, 14/153,722, 14/216,971, 13/923,571, 14/174,068, 14/175,657, the disclosure of each of which is hereby incorporated by reference in its entirety herein, or in U.S. Pat. No. 8,894,506, the disclosure of which is hereby incorporated by reference in its entirety herein.

In each of the embodiments disclosed herein, the weight cartridge 40 and the tube 30 may have any of the features or characteristics of the embodiments disclosed in U.S. Pat. Nos. 8,834,294 and 9,067,110, the disclosure of each of which is hereby incorporated in its entirety herein. In each of the embodiments disclosed herein, the elongated weight arm 100 preferably is composed of a lightweight material such as composite, plastic, aluminum, titanium, or steel. In each of the embodiments disclosed herein, the weight cartridge 40 permits a golfer to adjust the vertical (z-axis) location of the golf club head 10 center of gravity, while the elongated weight arm permits a golfer to adjust the face-to-rear (x-axis) location of the golf club head 10 center of gravity.

The golf club head 10 of the present invention also preferably includes an adjustable hosel assembly, such that loft, lie, and/or face angle can be changed by adjusting the position of a shaft (not shown) with respect to the hosel 19. The golf club head 10 may have any of the adjustable hosel assembly embodiments disclosed in U.S. patent application Ser. Nos. 13/311,319, 13/436,512, 13/368,569, 13/439,664, 13/367,045, 13/326,156, 13/332,846, 13/408,018, 13/544,037, and 13/660,882, the disclosure of each of which is hereby incorporated by reference in its entirety herein, or in U.S. Pat. Nos. 7,083,529, 7,427,239, 7,465,239, 7,578,749, 8,002,644, 8,096,895, 8,235,840, 8,257,193, the disclosure of each of which is hereby incorporated by reference in its entirety herein.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated by reference in its entirety herein.

The disclosure of U.S. Provisional Patent Application No. 61/684,079 is hereby incorporated by reference in its entirety herein. The disclosure of U.S. Provisional Patent Application No. 61/727,608 is hereby incorporated by reference in its entirety herein. The disclosure of each of U.S. Pat. No. 7,147,573 to DiMarco and U.S. Pat. No. 7,166,041 to Evans is also hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body comprising a face, a rear portion, a hinge, an interior cavity, and a hosel;

an elongated weight arm comprising a first end, a second end, and a hinge receiver disposed at the second end; and a retaining cap, wherein the body comprises an elongated cutout sized to receive at least a portion of the elongated weight arm, wherein the hinge is located at the rear portion of the body proximate a first end of the elongated cutout, wherein the hinge receiver removably latches onto the hinge, wherein the retaining cap reversibly locks the elongated weight arm within the elongated cutout, and wherein a lower surface of the elongated weight arm is flush with an external surface of the body when the elongated weight arm is disposed within the elongated cutout.

2. The golf club head of claim 1, further comprising a weight cartridge, wherein the elongated weight arm comprises an elongated recessed region sized to receive the weight cartridge.

3. The golf club head of claim 2, wherein the elongated weight arm further comprises a clip feature sized to retain the weight cartridge within the elongated recessed region.

4. The golf club head of claim 3, wherein the elongated weight arm further comprises an overhang region disposed at a first end of the elongated weight arm.

5. The golf club head of claim 4, wherein the clip feature is disposed at a second end of the elongated weight arm, and wherein the overhang region and the clip feature removably retain the weight cartridge within the elongated recessed region.

6. The golf club head of claim 1, further comprising a cap screw having a lip portion and external threads, wherein the body comprises an opening proximate a second end of the elongated cutout, and wherein the opening comprises internal threads sized to engage with the external threads.

7. The golf club head of claim 6, wherein the first end of the elongated weight arm comprises a through bore, and wherein at least a portion of the cap screw extends through the through bore and engages the internal threads in the opening.

8. The golf club head of claim 7, wherein the lip portion extends over a portion of the elongated weight arm surrounding the through bore when the cap screw is fully engaged with the opening.

9. The golf club head of claim 7, further comprising a tube and a weight cartridge, wherein the body comprises a crown and a sole, wherein the cutout and the opening are disposed in the sole, wherein the tube extends between the crown and the sole through the interior cavity, wherein the opening communicates with the tube, and wherein the weight cartridge is sized to fit within the tube.

10. The golf club head of claim 9, wherein the cap screw comprises a counterbore, wherein the weight cartridge comprises a first end with a first density and a second end with a second density, and wherein the counterbore is sized to receive at least one of the first end of the weight cartridge and the second end of the weight cartridge.

11. The golf club head of claim 10, wherein the first density is greater than the second density.

12. The golf club head of claim 10, wherein the cap screw presses the weight cartridge against an internal surface of the crown.

13. The golf club head of claim 9, wherein each of the face and the sole is composed of a metal material, and wherein the elongated weight arm is composed of a non-metal material.

14. The golf club head of claim 13, wherein each of the crown and the elongated weight arm is composed of a composite material.

15. A golf club head comprising:

a body comprising a face, a rear portion, an interior cavity, a hinge, and a hosel;

an elongated weight arm comprising a first end, a second end, a lower surface, a hinge receiver sized to removably latch onto the hinge, and an elongated recess comprising a floor and at least two sides;

a retaining cap; and a slidable weight, wherein the body comprises an elongated cutout sized to receive at least a portion of the elongated weight arm, wherein the hinge is disposed at a first end of the elongated cutout, wherein the retaining cap reversibly locks the elongated weight arm within the elongated cutout, wherein at least two of the sides comprises a rail, wherein the slidable weight comprises rail-gripping features, and wherein a lower surface of the elongated weight arm is flush with an external surface of the body when the elongated weight arm is disposed within the elongated cutout.

16. The golf club head of claim 15, wherein the slidable weight comprises two pieces and a bolt.

17. The golf club head of claim 15, wherein the elongated weight arm can be pivoted around the hinge when the hinge receiver is engaged with the hinge.

* * * * *